US011413221B2

(12) United States Patent
Coleman

(10) Patent No.: US 11,413,221 B2
(45) Date of Patent: Aug. 16, 2022

(54) PACIFIER WITH DOWNLOADABLE VOICE AND MUSIC AND MONITORING CAPABILITIES

(71) Applicant: Chris Coleman, Hastings, FL (US)

(72) Inventor: Chris Coleman, Hastings, FL (US)

( * ) Notice: Subject to any disclaimer, the term of this patent is extended or adjusted under 35 U.S.C. 154(b) by 0 days.

(21) Appl. No.: 17/010,170

(22) Filed: Sep. 2, 2020

(65) Prior Publication Data

US 2022/0062113 A1 Mar. 3, 2022
US 2022/0183932 A9 Jun. 16, 2022

Related U.S. Application Data

(63) Continuation-in-part of application No. 15/257,946, filed on Sep. 7, 2016, now abandoned.

(51) Int. Cl.
*A61J 17/00* (2006.01)
*G08B 5/36* (2006.01)

(52) U.S. Cl.
CPC ..... *A61J 17/1011* (2020.05); *A61J 17/001* (2015.05); *G08B 5/36* (2013.01); *A61J 2200/70* (2013.01)

(58) Field of Classification Search
CPC .... A61J 17/001; A61J 17/101; A61J 17/1011; A61J 17/1012
See application file for complete search history.

(56) References Cited

U.S. PATENT DOCUMENTS 4,554,919 A * 11/1985 Hubert ..... A61J 17/1011 606/234
2018/0064612 A1* 3/2018 Coleman ..... A61J 17/1011

* cited by examiner

*Primary Examiner* — Todd J Scherbel
(74) *Attorney, Agent, or Firm* — Lawrence J. Gibney, Jr.

(57) ABSTRACT

This device will be a nipple that will soothe a child while providing soft noise for the child as well as providing perhaps educational material at the request of the parent. The sound itself can be emitted through a speaker and can be done wirelessly through a variety of wireless means. Alternatively, a chip may also be used to store various sounds that can be changed at the request of the user either remotely or locally. Because the parent will want to know when the child falls asleep, the noise from the device will automatically shut off once the child has stopped sucking on the pacifier.

5 Claims, 6 Drawing Sheets

PACIFIER WITH DOWNLOADABLE VOICE AND MUSIC AND MONITORING CAPABILITIES

RELATED APPLICATIONS

This is a continuation in part of a prior application and the applicant claims the benefit of a non-provisional application with a Ser. No. 15/257,946 and a filing date of Sep. 7, 2016.

BACKGROUND OF THE INVENTION

A. Field of the Invention

This relates to a pacifier that can be used to soothe a child while at the same time be instructional. Pacifiers are commonly used by children during the formative years. In addition to a device that the child can suck on, the device can also be used to train the child regarding voice and language to help a child become accustomed to language. Additionally material can be downloaded by the parents or guardians directly to the device. Although language is discussed, the parent can download music for the child to hear. The parent can also use a remote control to download the material. In addition, the power source and memory that is used with this device can be separated from the pacifier so that the pacifier can be cleaned without any risk of damaging the electronics that are embedded in the pacifier.

B. Prior Art

There are prior art references regarding pacifiers that produce sound. A representative example of this type of device can be found at Uhler, U.S. Pat. No. 5,662,685. This device is a pacifier that can play music and can be activated to play music remotely. It will be in the general shape using a nipple and a handle. In addition, it is discussed that the beeping would be a means for assisting in locating the pacifier as well as a means to illuminate the surface.

Another example in the prior art for locating the pacifier can be found at Jones, U. S. Publication 2007/0049972. Also, a pacifier that has sound-generated activity with a locator can be found at Harlan, U.S. Pat. No. 6,102,935. However, it improves upon this by enabling the device to be disinfected as part of the structure without destroying the device itself. Additionally, there will be a means to illuminate the device in the event the pacifier is lost.

BRIEF SUMMARY OF THE INVENTION

Pacifiers are commonly used to soothe babies and are typically placed in the baby's mouth. This is a variation of this type of idea by using a pacifier that has the further capability of storing information within a portion of the pacifier. The type of material that can be downloaded includes the voice of a parent, music or a person reading a book for examples. A speaker will also be included, and the parent can alter the volume of the sound using remote control capabilities.

This device will enable the parent to teach the child language while at the same time soothing a child. Additionally the material that can be downloaded can be changed by the parent using wireless technology that is prevalent today.

Because this device is placed in a child's mouth it is important to also be able to clean the device without damaging the power source or the electronic components of the device. The top portion of the device can be detached from the bottom so that the parent can clean and/or disinfect the pacifier.

This device can also be operated by a remote-control device and the sound that is being emitted can be changed in terms of a chip or by using wireless capability. Additionally, because a power source must be used, the power source may be rechargeable.

In addition, there is also a means to illuminate the device in the event it is misplaced or lost. This means to illuminate can be activated remotely.

Sometimes children will take a baby bottle or infant cup to his or her room and fall asleep while using the bottle or cup during normal feeding. A means to notify the parent when the child is done using the pacifier or when the child has fallen asleep will also be provided. This will enable the parent to know when the child is done and no longer using the device.

With this device once the child stops holding the device for a predetermined period of time because the child has fallen asleep the sound being emitted will cease.

NUMBERING DESCRIPTION

Figure 1:
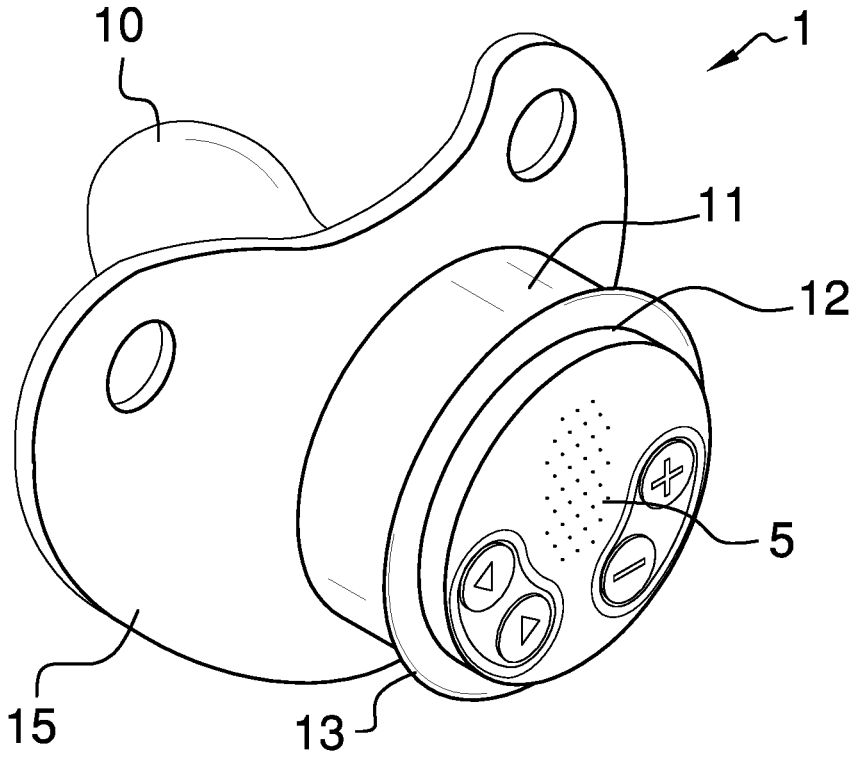
FIG. 1 is an isometric view of the device.
Figure 2:
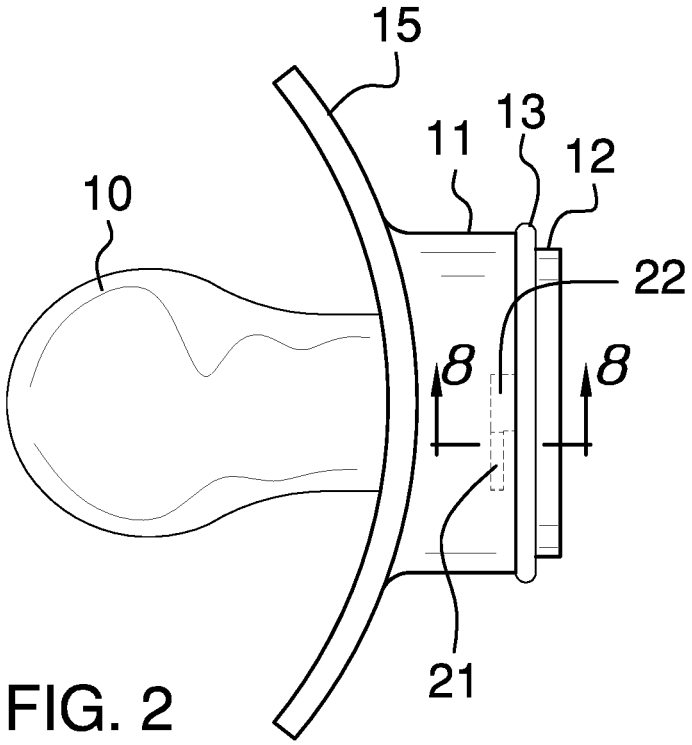
FIG. 2 is a side view of the device.

1—Device
5—Speaker
10—Nipple
11—Shroud flange
12—Detachable portion surface
13—Rim
15—Shroud
20—USB Port
21—Twist Lock
22—Slot
25—Volume Control
30—Play Selector
35—Detachable portion
40—Shroud and nipple assembly

DETAILED DESCRIPTION OF THE EMBODIMENTS

This device 1 is a pacifier, which is commonly used by parents soothe children, usually infants. As the child uses the pacifier the child perfects the sucking action that is necessary for the development of a child.

This device, however, allows the parents the added features of being able to teach the child language or music with the use of this pacifier.

This pacifier 1 has a nipple 10 that is inserted into the child's mouth and a shroud 15 that conforms to the general shape of a child's mouth. There are two sections: a detachable portion 35 and a shroud and nipple assembly 40; these sections are separable from each other.

The shroud 15, which will take the shape of the child's mouth separates the surface of the nipple 10 from a flanged surface 11 on the surface of the shroud and nipple assembly 40. The interior of the flanged surface 11 is hollow. A pair of diametrically opposed slots 22 are placed within the interior of the hollow portion of the flanged surface 11.

The detachable portion 35 is comprised of a detachable portion 35 portion surface 12 on either side of a rim 13. The housing component 35 contains the controller, USB port, speaker, the light and volume and lighting controls. A pair of twist locks 21 are placed on the outside of the inner surface of the detachable portion 35.

When the device 1 is assembled such as depicted in FIG. 1 the detachable portion surface 12 fits within the hollow area of the shroud flange 11. The twist locks 21 that are on the outside of the surface of the detachable portion 35 are placed with the corresponding slots 22 on the interior of the shroud flange 11 and the detachable portion 35 and shroud and nipple assembly 40 are twisted to lock the two pieces in place.

Figure 7:
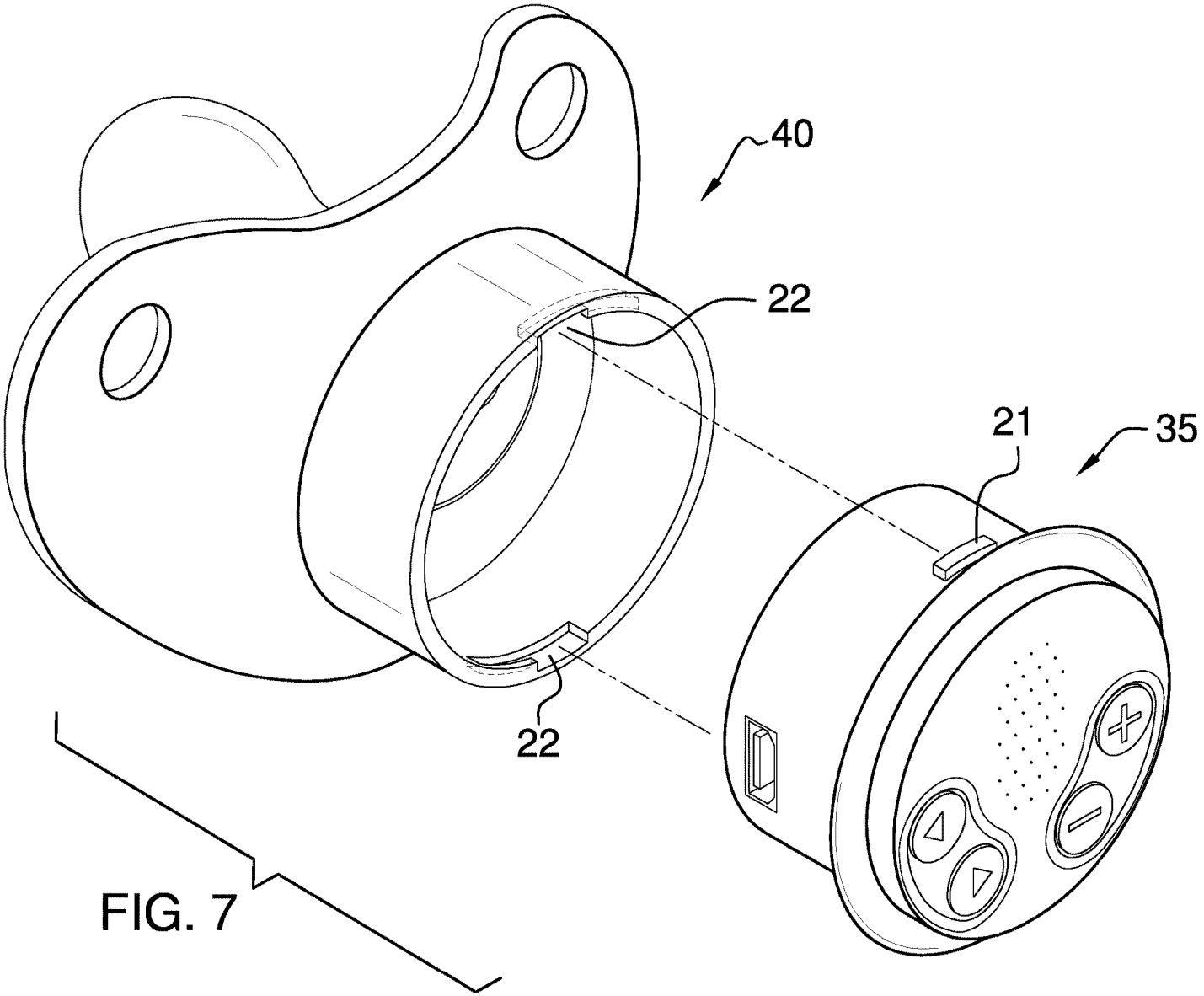
FIG. 7 is a perspective view of the locking mechanism.
Figure 8:
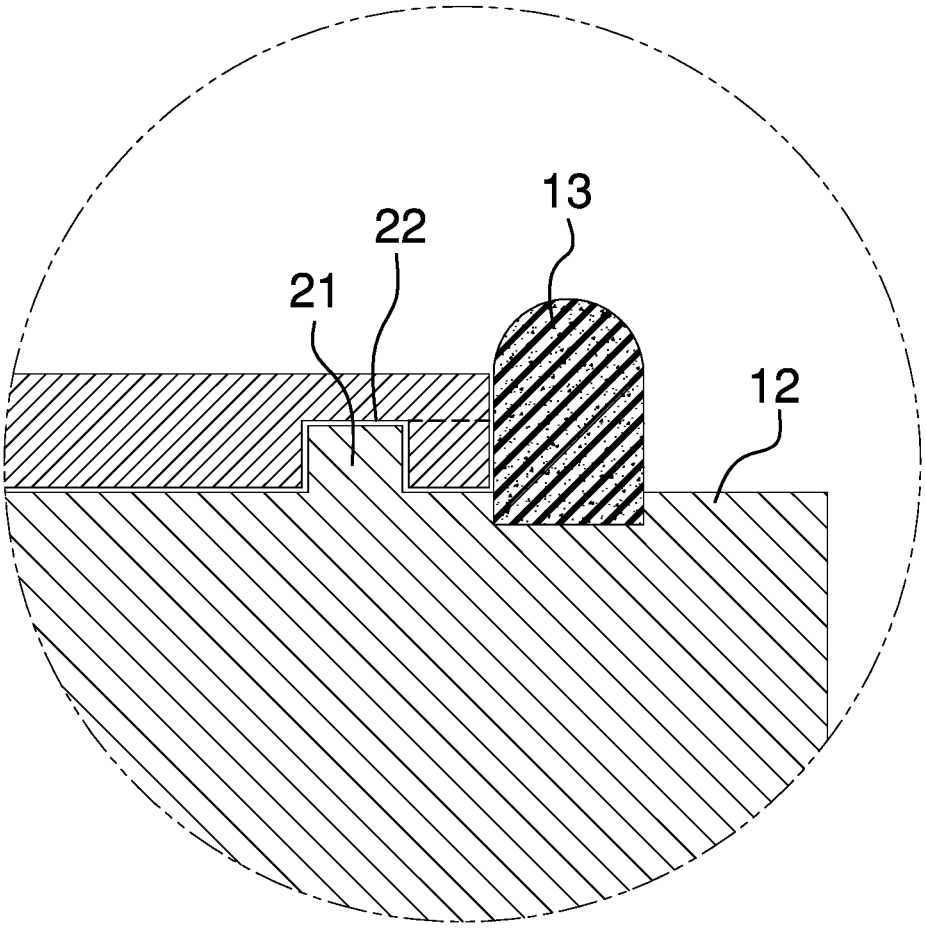
FIG. 8 is a cross-sectional view according to line 8-8 on FIG. 2

The detachable portion 35 contains the USB port 20. A rim 13 separates the housing first surface from the housing second surface. The rim 13 is used to grip the detachable portion 35 and twist it to lock the sections together. The two sections are joined together using a twist lock 21 and slot mechanism 22 such as depicted in FIGS. 7 and 8.

The detachable portion 35 can be separated from the shroud and nipple assembly 15 for cleaning the nipple 10 while eliminating any risk of damaging the electronics of the device, which are contained in the detachable portion 35. The two sections—detachable portion 35 and shroud and nipple assembly 40—are joined together during normal use and the two sections will remain in place during the normal operation of the device. The two sections can be joined together using a twist lock or snap mechanism as examples. Regardless of the means to join the sections, the primary purpose is to ensure that the two sections remain joined together during normal use. Often the pacifier will also have a handle (not depicted) that can be used to insert the pacifier into the child's mouth.

Figure 3:
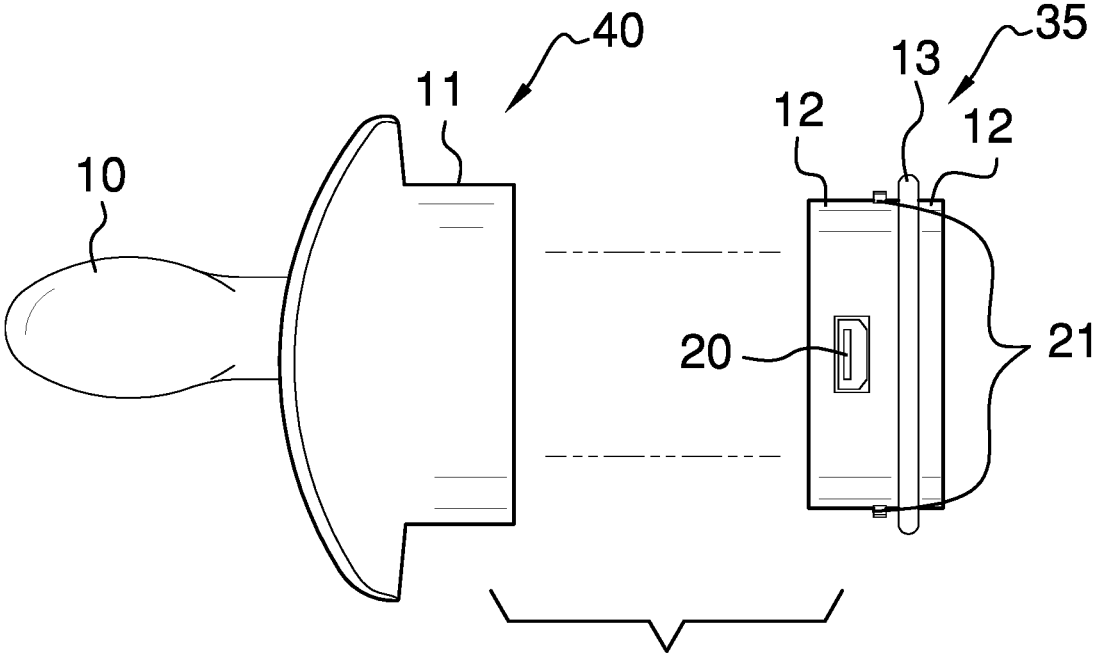
FIG. 3 is an exploded view of the device showing the electronic components being removed from the pacifier portion of the device.
Figure 4:
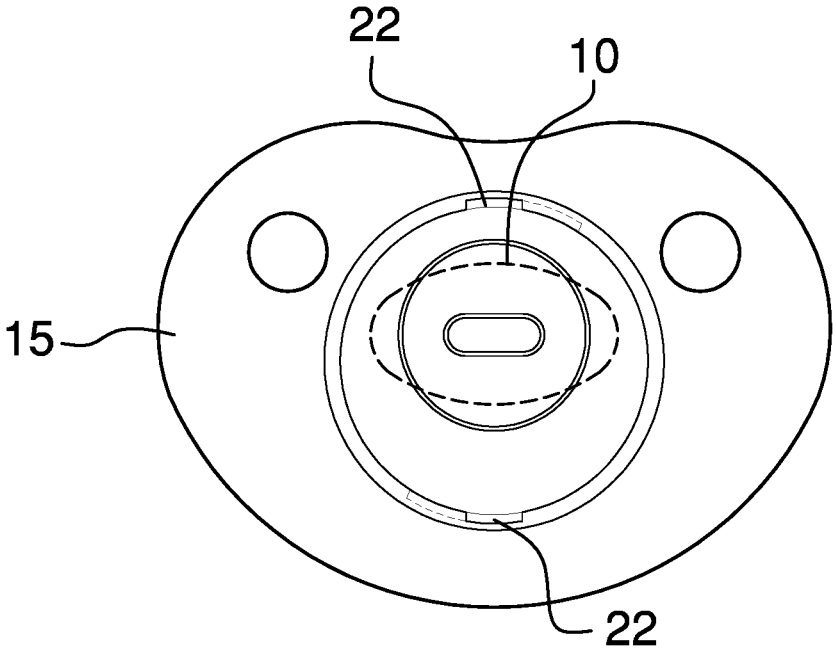
FIG. 4 is a front view of the device.

The detachable portion 35 such as depicted in FIG. 3 allows the pieces of this device to be separated so that the portion of the pacifier with the nipple can be cleaned or disinfected by the parent without any risk of damaging the electronic components of the device.

Figure 6:
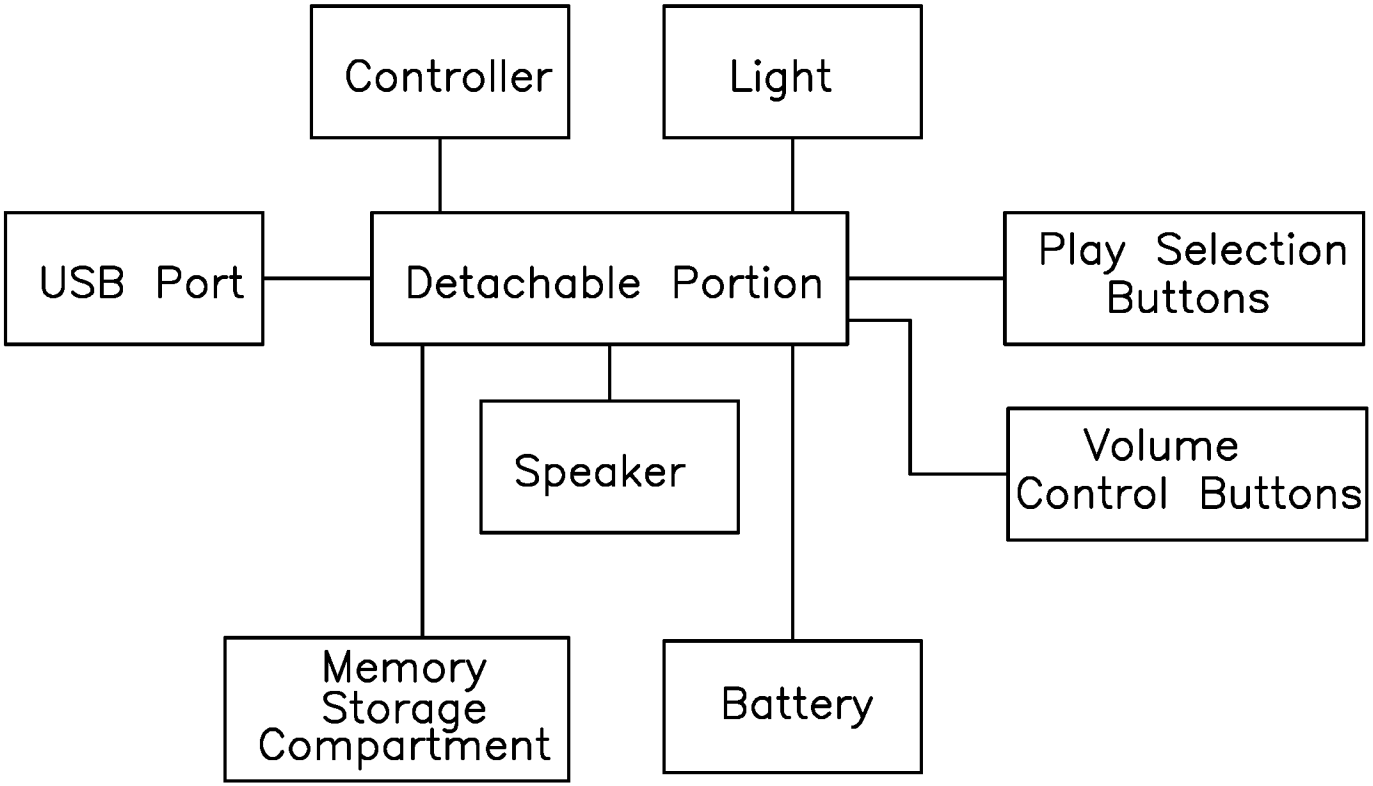
FIG. 6 is a schematic of the components.

In the detachable portion 35 a controller is provided that will control all the electronic functions of the pacifier and its components such as depicted in FIG. 6 and enable the parent to download material onto the pacifier. This downloadable material can be as varied as desired by the parent. Possible examples may be prerecorded messages of love and affirmation by the parent, a parent reading a book, music for the child or a third party voicing a message.

Figure 5:
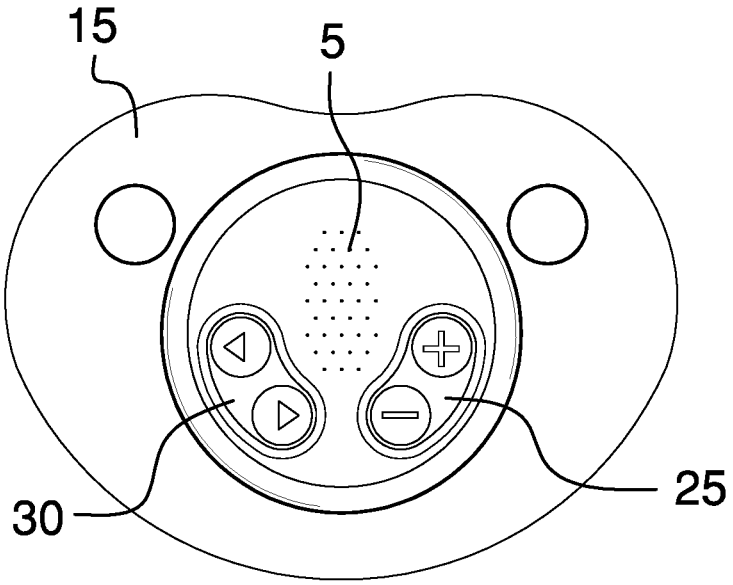
FIG. 5 is a back view of the pacifier.

The detachable portion 35 will house a USB port 20 where the parent can download different types of material or recharge the power source that is contained in the detachable portion. Material can also be downloaded using wireless technology that is commonly used today. When the two sections are joined together such as depicted in FIG. 1 the USB port 20 is hidden from view by the shroud flange 11. A speaker 5 will also be included in the detachable portion as well as a play selection button 25 and a volume control 30 such as depicted in FIG. 5.

Pacifiers are commonly misplaced and a chip to locate the pacifier will also be included as well as a small light (not depicted) to locate the device in a darkened area.

Additionally, the parent can be alerted when the child stops using the pacifier when the sound of the pacifier stops after the child stops sucking after a predetermined amount of time.

When the parent wants to change the material that is downloaded this can be done using a remote-control device or through the USB port. A chip or memory stick will be provided to store the plurality of files that will be used. This plurality of files will include audio files as well as music files, to name a few examples.

While the embodiments of the invention have been disclosed, certain modifications may be made by those skilled in the art to modify the invention without departing from the spirit of the invention.

The inventor claims:

1. A pacifier with downloadable voice and music and monitoring capabilities, which is comprised of:

a. a shroud and nipple assembly;

wherein a nipple is provided on a first end of the shroud and nipple assembly;

wherein a flange having a flanged surface is provided on a second end of the shroud and nipple assembly;

b. the nipple;

wherein the nipple is a predetermined shape;

c. a shroud;

wherein the shroud conforms to the shape of a child's mouth;

wherein the shroud is non-separable from the nipple;

wherein the flanged surface of the shroud and nipple assembly is non-separable from the shroud;

wherein the flanged surface includes a hollow portion;

d. a power source;

wherein the power source is rechargeable;

e. a detachable portion;

wherein the detachable portion can be placed within the hollow portion of the flanged surface;

wherein a USB port is placed on a side of the detachable portion;

wherein the USB port is covered by the flanged surface of the flange of the shroud and nipple assembly when the two sections are put together;

wherein the detachable portion and the shroud and nipple assembly are separable from each other into only two sections;

wherein the power source is provided within the detachable portion;

wherein a controller is provided within the detachable portion;

wherein a memory storage component is provided within the detachable portion;

wherein content can be downloaded into the memory storage component;

wherein the content can be downloaded using wireless technology;

wherein the content can be downloaded using the USB port;

wherein a speaker is provided in the detachable portion;

wherein a selector button is provided on the detachable portion;

wherein a volume control is provided;

wherein a light is provided;

an alert;

wherein the alert is provided when the child stops sucking the pacifier for a predetermined period of time.

2. The pacifier as described in claim 1 wherein the memory storage component is a memory chip.

3. The pacifier as described in claim 1 wherein a predetermined set of sounds can be accessed using a wireless transmitter.

4. The pacifier as described in claim 1 wherein the power source is a rechargeable battery.

5. The pacifier as described in claim 1 wherein the content contains audio files.

* * * * *